United States Patent [19]

Douglass

[11] 4,420,103

[45] Dec. 13, 1983

[54] BACKPACK

[75] Inventor: Donald C. Douglass, Ventura, Calif.

[73] Assignee: Wilderness Group Inc., Ventura, Calif.

[21] Appl. No.: 415,473

[22] Filed: Sep. 7, 1982

[51] Int. Cl.[3] ..... A45F 3/04

[52] U.S. Cl. ..... 224/210; 224/209; 224/261; 224/153; 224/907

[58] Field of Search ..... 224/215, 153, 209, 210, 224/211, 212, 213, 216, 259, 260, 261, 262, 263, 907

[56] References Cited

U.S. PATENT DOCUMENTS 3,622,056 11/1971 Droeger ..... 224/153 X
3,774,825 11/1973 Schone et al. ..... 224/262 X
4,356,942 11/1972 Hayes ..... 224/211

FOREIGN PATENT DOCUMENTS 2486783 1/1982 France ..... 224/259

*Primary Examiner*—Steven M. Pollard
*Attorney, Agent, or Firm*—Harris, Kern, Wallen & Tinsely

[57] ABSTRACT

A backpack with integral frame formed of plastic sheets without metal supports. A load carrying sack having a front face, a pair of shoulder straps and a waistband, and a support pad mounted on the front face, the pad comprising a foam sheet of a first height, a stiffener sheet of a second height less than said first height, and a protective sheet, with the three sheets attached to the front face by stitching forming vertical panels and upper and lower horizontally pivoting structures with a stiff intermediate structure.

5 Claims, 5 Drawing Figures

BACKPACK

BACKGROUND OF THE INVENTION

This invention relates to backpacks and in particular to a new and improved integral frame backpack.

The Ruck sack with shoulder straps but no frame of any type has been used for many years and still is satisfactory for light loads. The backpack with external frame, originally of wood and now of lightweight metal has been highly developed and is an excellent piece of equipment for heavy loads and trail hiking. The external frame permits carrying of all manner of equipment and distributes the load between the shoulders and waist while providing ventilation between the pack and the hiker. The external frame pack is not suitable for climbing because the load center of gravity is spaced backward from the climber. The frameless or wraparound pack is used for climbing, with the load within the pack and the harnessing providing the stiffening. While being light in weight, the frameless pack is not particularly satisfactory for hiking, particularly in hot weather, because of the close contact between the pack and the hiker.

More recently, the internal frame pack has been used in place of the external frame pack because of the reduction in weight. The internal frame pack has some of the structural characteristics of the frameless pack, but it does utilize vertical metal bars in the pack to provide stiffness.

The various packs referred to above suit certain conditions and have problems with other conditions, and it is an object of the present invention to provide a new and improved backpack with an integral frame which will be relatively light in weight, comfortable, with padding and stiffening and ventilation. It is a further object of the invention to provide such a backpack which does not utilize any metal frame members internally or externally, and which inherently contours itself to fit the back when in use.

These and other objects, advantages, features and results will more fully appear in the course of the following description.

SUMMARY OF THE INVENTION

A backpack with integral frame comprising a load carrying sack with a front face, a pair of shoulder straps and a waistband, and a support pad mounted on the front face. The support pad comprises a foam sheet of a first height, a stiffener sheet of a second height less than the first height, and a protective sheet, with the stiffener sheet, foam sheet and protective sheet attached to the front face by stitching. A plurality of horizontal rows of stitching define upper and lower sandwich structures of the front face, foam sheet and protective sheet, and an intermediate sandwich structure of the front face, stiffener sheet, foam sheet and protective sheet. Vertical rows of stitching define vertically disposed panels, with the stitching compressing the foam sheet onto the stiffener sheet providing an arcuate structure, with vertical grooves at the outer surface for ventilation. The upper and lower sandwich panels pivot at the horizontal rows of stitching and are individually bendable, permitting contouring of the pack to the back of the wearer.

DESCRIPTION OF THE PREFERRED EMBODIMENT

Figure 1:
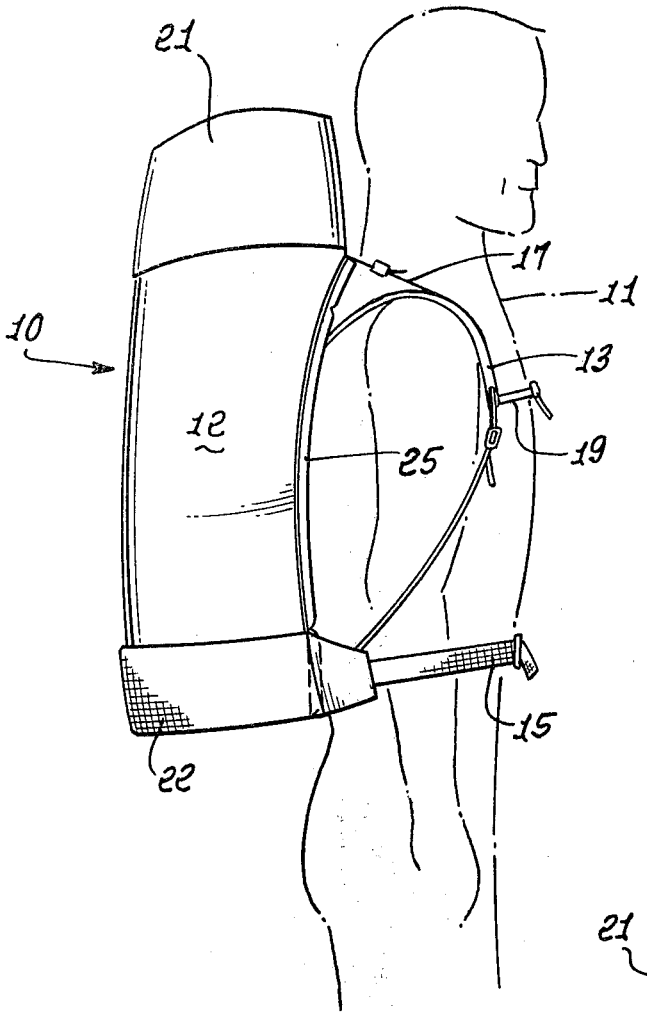
FIG. 1 is a side view of a backpack on a wearer, and incorporating the presently preferred embodiment of the invention.
Figure 2:
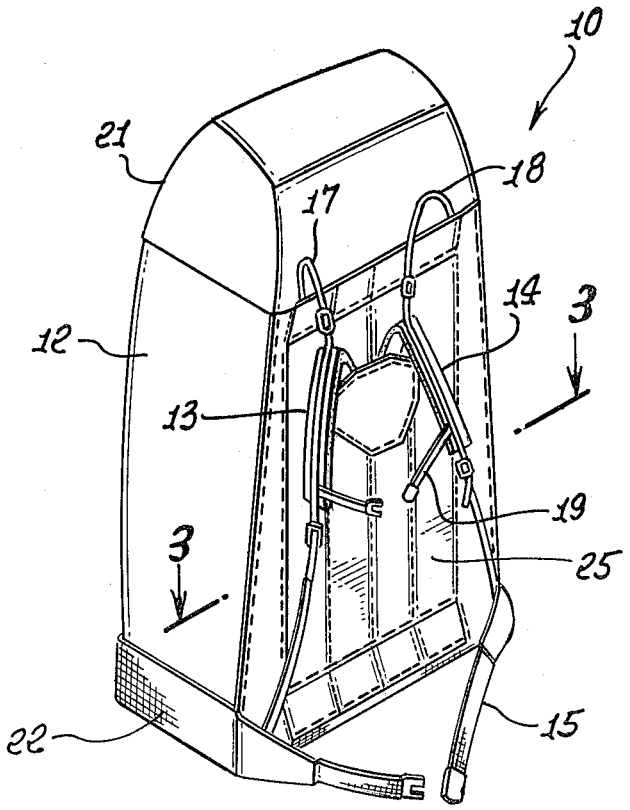
FIG. 2 is a front perspective view of the backpack of FIG. 1.

FIG. 1 shows the integral frame backpack 10 on a hiker 11. The pack 10 includes a load carrying sack 12, a pair of shoulder straps 13, 14, and a waistband 15. The pack may also include adjustable load straps 17, 18, and a chest band 19. The sack 12 may take various forms, and the sack illustrated in FIGS. 1 and 2 includes a top load section 21, and an outer reinforcing cover 22 at the bottom. The sack as described thus far may be conventional in design and construction.

Figure 3:
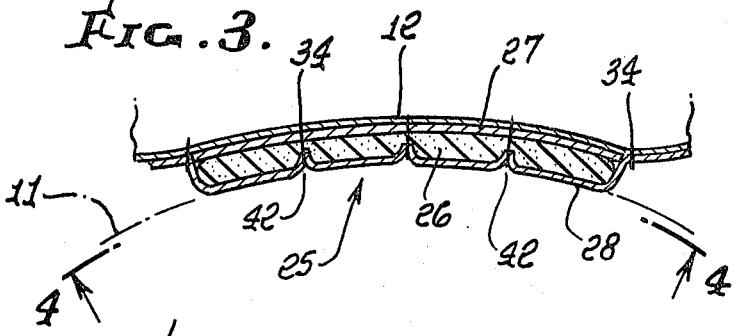
FIG. 3 is an enlarged partial sectional view taken along the line 3—3 of FIG. 2.
Figure 4:
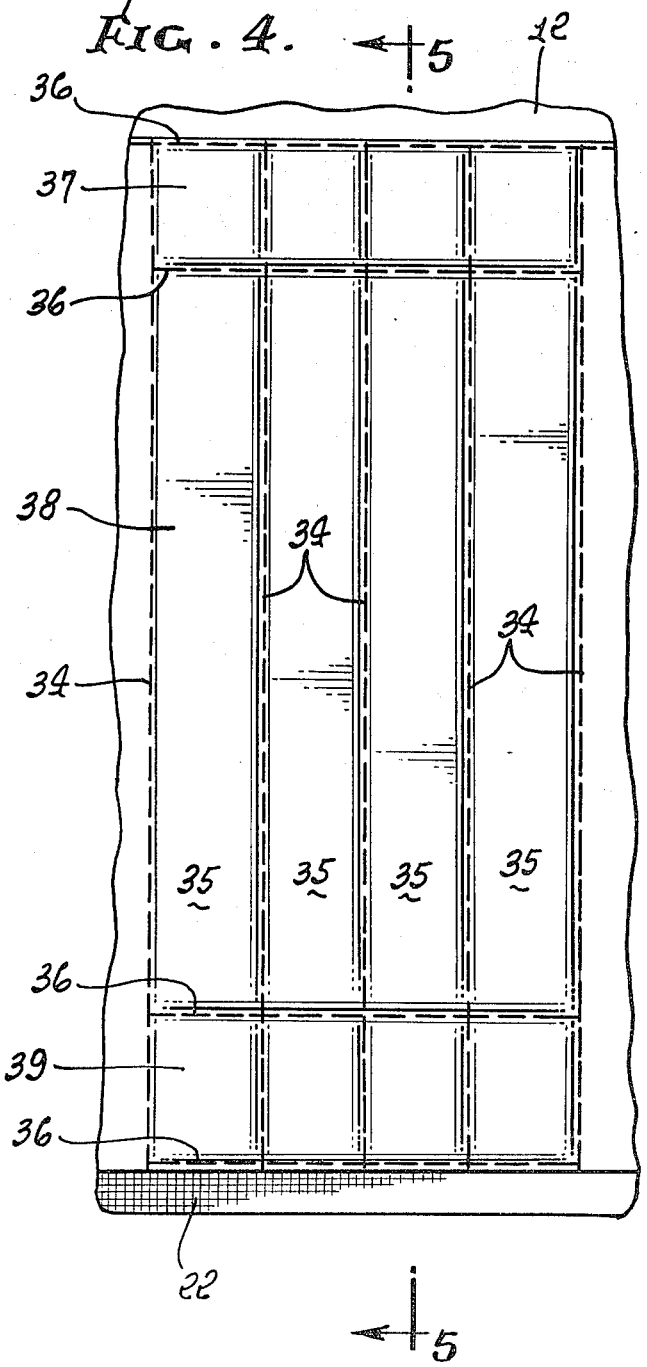
FIG. 4 is a partial sectional view taken along the line 4—4 of FIG. 3.
Figure 5:
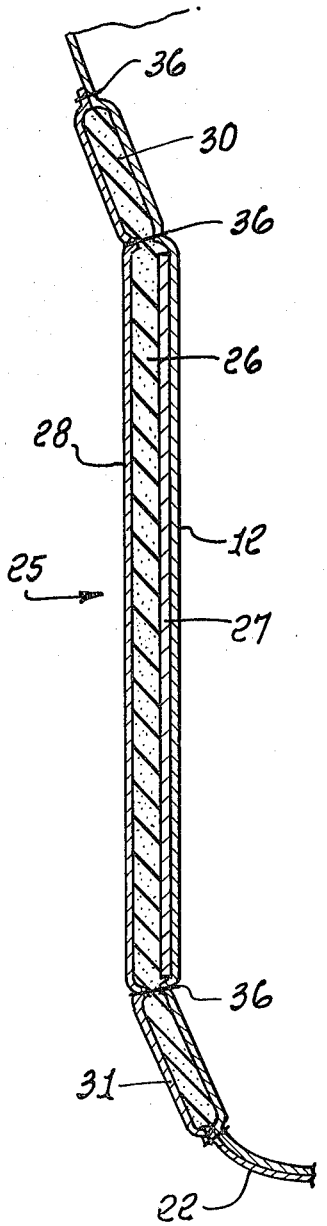
FIG. 5 is a partial sectional view taken along the line 5—5 of FIG. 4.

A support pad 25 is mounted on the front face of the sack 12, and is shown in greater detail in FIGS. 3–5.

The pad 25 includes a foam sheet 26, a stiffener sheet 27, and a protective sheet 28. The foam sheet is of a size to overlie the wearer's back and typically is about eight inches wide and about 24 inches high. The stiffener sheet should be substantially the same width as the foam sheet, but not as high, leaving upper and lower sections 30, 31 of the foam sheet projecting above and below the stiffener sheet. The protective sheet must overlie the foam sheet and preferably projects laterally on each side of the foam sheet and connects with the waistband.

The protective sheet, the foam sheet and the stiffener sheet are attached to the front face of the pack by stitching, as shown in FIGS. 3, 4 and 5. In the embodiment illustrated, five vertical rows of stitching 34 produce four vertical panels 35, and four horizontal rows of stitching 36 produce an upper structure 37, an intermediate structure 38, and a lower structure 39. The stitching compresses the foam sheet, pulling the protective sheet down against the stiffener sheet, as seen in FIG. 3, producing vertical grooves 42 and pulling the sandwich construction into an arcuate shape. The vertical grooves provide for ventilation along the wearer's back, and the arcuate shape improves the contouring of the pack to the wearer.

The stiffener sheet is not rigid, permitting the arcuate shape as shown in FIG. 3. The stiffener sheet also permits contouring of the pack to the back, as shown in FIG. 1. However the sheet is sufficiently stiff to provide the necessary stiffness for the pack. The stiffener sheet being shorter than the foam sheet, does not project upward into the section 30 or downward into the section 31. This permits these two sections to pivot along the horizontal stitching, as shown in FIG. 5, permitting the pad to conform to the wearer's shoulders and hips.

This construction provides optimum load carrying capacity with maximum comfort and minimum weight. The somewhat flexible pad with pivoted upper and lower sections, all integral with the sack functions to transfer the load directly from the sack to the body while eliminating metal supports, poking objects, wear points and corrosion.

Typically the various components of the bag and the protective sheet are made of a plastic fabric, such as nylon. The foam sheet typically is a plastic foam in the order of ½ inch thick and by way of example may be a polyethylene closed cell foam. The stiffener sheet is a thin high density material having a slight amount of flexibility and typically is an acrylic-polyvinyl chloride alloy about 0.028 inches thick. Plastics of this type are of high density with high impact strength while at the same time can be sewn between fabric layers in sandwich assemblies.

I claim:

1. A backpack with integral frame, including in combination:

a load carrying sack having a front face, a pair of shoulder straps and a waistband; and a support pad mounted on said front face; said pad comprising a foam sheet having a first height, a stiffener sheet having a second height less than said first height, and a protective sheet, with said stiffener sheet, foam sheet and protective sheet attached to said front face by stitching, with a plurality of vertical rows of stitching defining vertically disposed panels, and a plurality of horizontal rows of stitching defining upper and lower sandwich structures of front face, foam sheet and protective sheet, and an intermediate sandwich structure of front face, stiffener sheet, foam sheet and protective sheet.

2. A backpack as defined in claim 1 with said upper and lower sandwich structures pivoting about horizontal rows of stitching relative to said intermediate structure, and being bendable between horizontal rows of stitching.

3. A backpack as defined in claim 1 with said vertical rows of stitching compressing said foam sheet onto said stiffener sheet producing an arcuate structure with vertical grooves at the outer surface thereof.

4. A backpack as defined in claim 3 with said protective sheet projecting laterally outward from said foam sheet with said waistband joined to said protective sheet and with said shoulder straps joined at their lower ends to said waistband and at their upper ends to said intermediate sandwich structure.

5. A backpack as defined in claim 3 wherein said foam sheet is a relatively thick and closed cell plastic foam sheet, and said stiffener sheet is a relatively thin and high density, high impact plastic sheet.

* * * * *